United States Patent [19]

White

[11] 4,030,442

[45] June 21, 1977

[54] MARINE PROPULSION DEVICE

[76] Inventor: Herbert O. White, 4242 E. Wilshire Drive, Phoenix, Ariz. 85008

[22] Filed: Aug. 26, 1976

[21] Appl. No.: 717,604

[52] U.S. Cl. ..... 115/14; 115/53; 415/149 A

[51] Int. Cl.[2] ..... B63H 25/46

[58] Field of Search ..... 114/151, 150; 115/11, 115/12 R, 12 A, 14, 16, 49, 50, 53; 415/148, 149 R, 152, 2; 60/221

[56] References Cited

UNITED STATES PATENTS

| | | | |
|---|---|---|---|
| 3,606 | 5/1844 | Von Schmidt | 115/16 |
| 133,275 | 11/1872 | Wells | 115/16 |
| 973,869 | 10/1910 | Logan | 415/2 |
| 1,050,458 | 1/1913 | Hilden | 115/53 |
| 3,116,011 | 12/1963 | Laing | 415/149 |
| 3,557,736 | 1/1971 | Baer | 114/151 |

FOREIGN PATENTS OR APPLICATIONS

| | | | |
|---|---|---|---|
| 1,157,994 | 7/1969 | United Kingdom | 114/151 |

*Primary Examiner*—Trygve M. Blix
*Assistant Examiner*—D. W. Keen
*Attorney, Agent, or Firm*—Don J. Flickinger

[57] ABSTRACT

A housing having a water conducting channel therethrough is secured to the underside of a vessel below the water line thereof. Water is urged through the channel by a propeller which unidirectionally rotates about a vertical axis. The direction of movement of the vessel is in response to the direction of movement of water through the channel which is controlled by operatively movable gate means which direct water flow through the channel along selective paths for contact with discriminate sectors of the cylinder described by the rotating propeller.

7 Claims, 10 Drawing Figures

FIG. 1
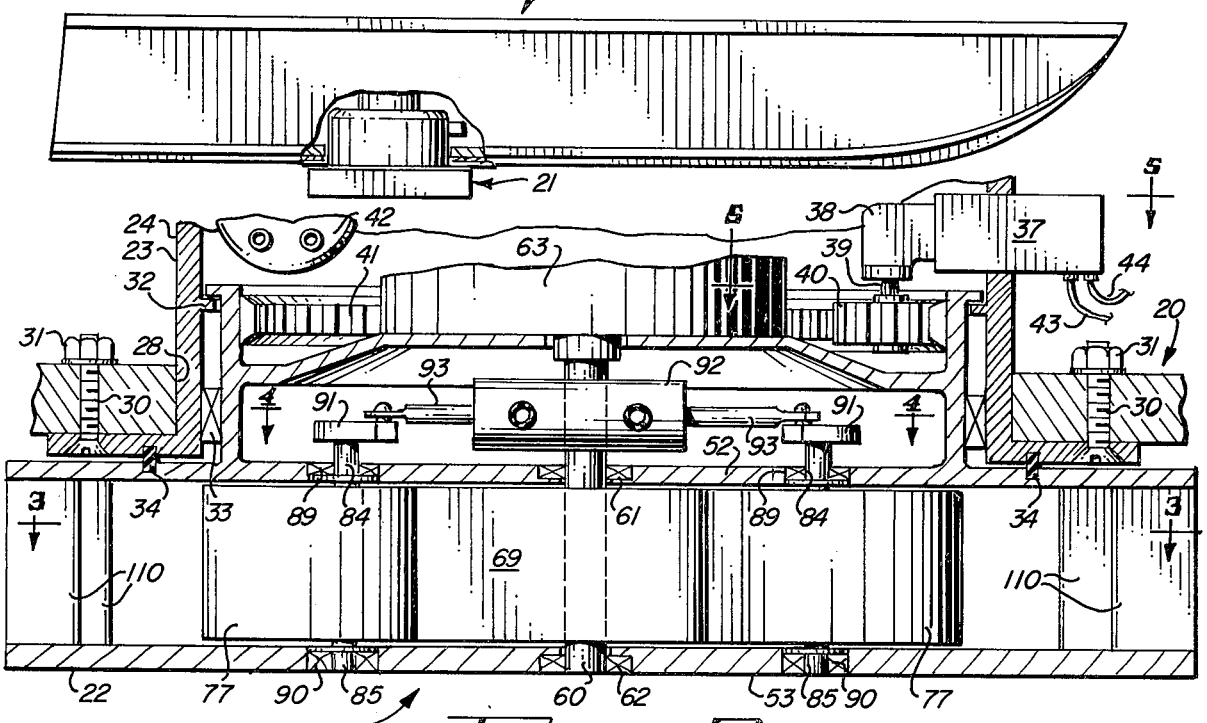
FIG. 2
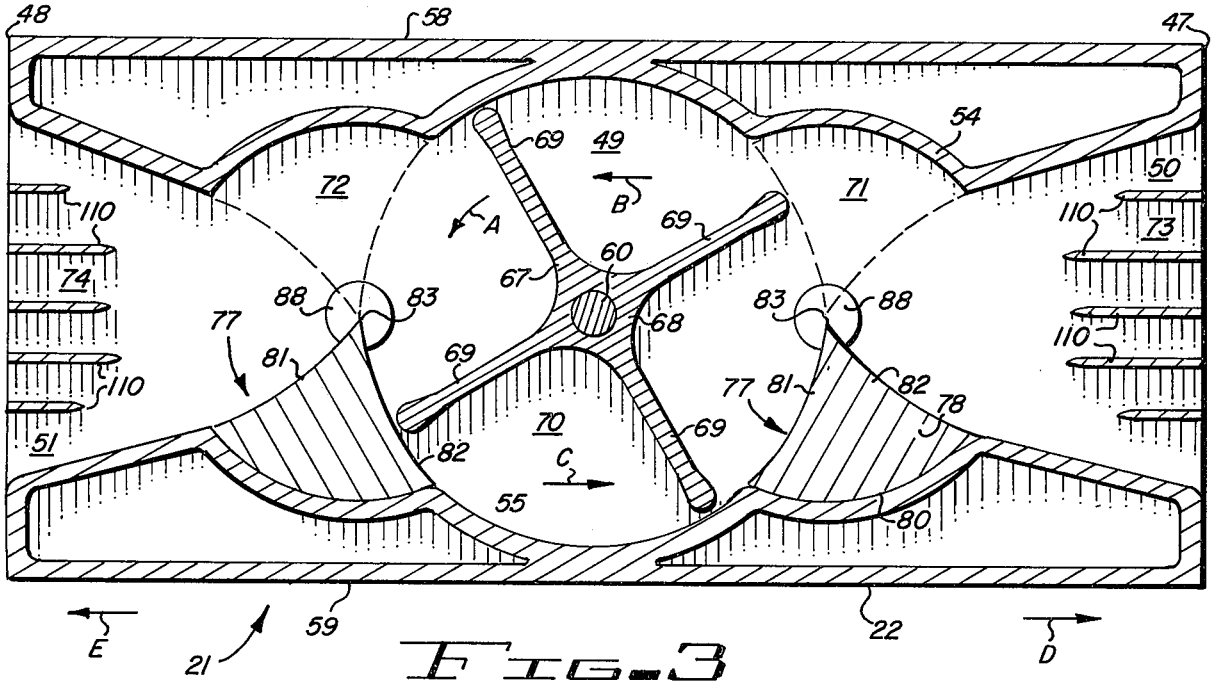
FIG. 3

MARINE PROPULSION DEVICE

This invention relates to marine vessels.

More particularly, the present invention concerns a drive unit for propelling a marine vessel through the water.

In a further aspect, the instant invention concerns a marine propulsion device of the type having a propeller which rotates about a vertical axis.

Various schemes have been proposed for propelling a marine vessel through the water. Among the most familiar conventional prior art devices are the paddle wheel, reminiscent of the Mississippi river boat, and screws associated with either inboard or outboard power units. Although adequate to propel a water craft, each has certain inherent limitations. The paddle wheel tends to be large and cumbersome, and is exceedingly susceptible to entanglement or damage by floating debris. On the other hand, the screw increases the draught of the vessel and is readily fouled or damaged by submerged debris or hazards.

In an attempt to overcome the foregoing deficiencies, namely to produce a marine drive system which will operate effectively in fouled or shallow water, the prior art has produced numerous apparatus. An exceedingly simple plan encases the screw in a guard, such as a tunnel, through which the water passes. Debris, of course, such as seaweed, for example, can still be drawn into the tunnel and entangle the screw. The immediate problem is effectively eliminated by air drive units utilizing conventional propellers or jet propulsion. However, such devices substantially raise the center of gravity of the vehicle, present a potential safety hazard, and give rise to other problems. Other solutions enclose augers or paddle wheels within the hull of the ship and include systems of water passage therethrough.

One concept which generated considerable interest among the prior art involved the use of a horizontal paddle wheel or propeller which rotates about a vertical axis. In the proper configuration, the horizontal propeller adds very little to the draught of the vessel and therefore represents a potential asset for water craft which regularly operate in shallow water. However, the full potential of such propulsion devices has never been adequately recognized nor thoroughly developed. For example, prior art horizontal propellers are as susceptible to damage and fouling as conventional screws. Problems of steering and direction have presisted. Often times the horizontal propeller, basically a relatively simple apparatus, has been incorporated into elaborate, complex schemes requiring especially designed hulls and being exceedingly expensive to manufacture. Other arrangements have simply failed to convert the thrust potential of the propeller to usable propulsive force.

It would be highly advantageous, therefore, to more fully recognize the potential of the horizontal propeller for use in combination with ships and boats.

Accordingly, it is a principal object of the present invention to provide an improved marine propulsion device of the type having a propeller which rotates about a vertical axis.

Another object of the invention is the provision of a marine propulsion device which will not substantially increase the draught of the vessel.

Yet another object of the invention is the provision of a marine propulsion device especially adapted for use in fouled water, having snags, hazards and other floating debris.

Still another object of the instant invention is to provide such a device with a unidirectionally rotating propeller which can move the craft in selective rearwardly and forwardly directions.

And another object of the invention is the provision of a marine propulsion device having improved steering means.

A further object of the invention is to provide a drive unit which is suited to be either incorporated into custom hull designs or attached to pre-existing conventional hull configurations.

And a further object of the instant invention is the provision of a marine propulsion device of the above type which is exceedingly durable, yet relatively simple and inexpensive to manufacture.

Briefly, to achieve the desired objects of the present invention in accordance with a preferred embodiment thereof, first provided is a housing having a water conducting channel therethrough and adapted for attachment to a vessel below the water line thereof. A propeller resides within the water channel and unidirectionally rotates about a normally vertical axis. Operatively movable gate means carried by the housing direct water flow along selective paths within the channel for contact with selective sectors of the cylinder described by the rotating propeller. The vessel moves in one direction when water is directed against one selected sector and moves in a reverse direction when water is directed against another sector.

In a further embodiment, the device includes a second unidirectional propeller spaced laterally from the first propeller and rotating in a direction opposite thereto. Gate means selectively direct water along a first path generally central of the channel, or a second split path along the sides of the channel, to control the forward and reverse direction of the vessel. In yet another embodiment, the housing is rotatable to provide steering.

The foregoing and further and more specific objects and advantages of the present invention will become apparent to those skilled in the art from the following detailed description of the preferred embodiments thereof taken in conjunction with the drawings, in which:

FIG. 1 is a side view of a typical conventional boat, partly broken, having a propulsion device constructed in accordance with the teachings of the present invention;

FIG. 2 is an enlarged vertical sectional view of the propulsion device of FIG. 1, taken generally along the center line thereof;

FIG. 3 is a horizontal sectional view taken along the line 3—3 of FIG. 2 and particularly illustrating the water channel therethrough, including the propeller and the gates;

Figure 4:
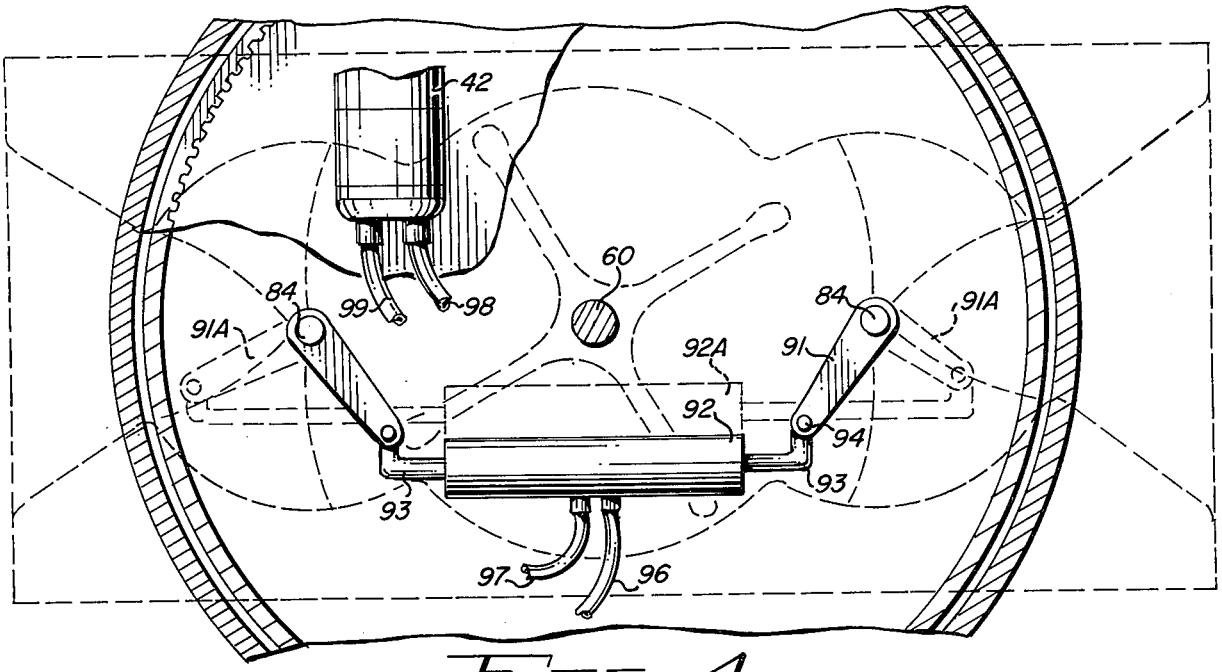
FIG. 4 is a horizontal sectional view taken along the line 4—4 of FIG. 2 and showing a hydraulic arrangement for operatively moving the gates.

Turning now to the drawings, in which the same reference numerals indicate corresponding elements through the several views, attention is first directed to FIG. 1, which shows a marine vessel generally designated by the reference character 20. Although specifically illustrated as a fishing boat, vessel 20 is intended to be generally representative of various types of water craft. A propulsion device, generally designated by the reference character 21 and constructed in accordance with the teachings of the present invention, is secured to the hull of vessel 20.

As seen in FIG. 2, propulsion device 21 includes housing 22 and mounting bracket 23. Mounting bracket 23 has an upright cylindrical section 24 and an outwardly directed annular flange 25. In accordance with an embodiment of the invention, propulsion device 21 is attached to boat 20 by forming a circular opening 28 in the bottom 29 of the hull of the boat. Opening 28 is sized to closely receive cylindrical section 24 as the mounting bracket 23 is moved upwardly during assembly, until flange 25 abuts the underside of bottom 29. A plurality of bolts 30 extend through appropriately sized and aligned apertures in flange 25 and bottom 29 and are engaged with nuts 31 in accordance with conventional practice. To prevent water leakage into the boat, a sealant may be placed between mounting bracket 23 and bottom 29.

A second cylindrical section 32 extends upwardly from housing 22 and is received within cylindrical section 24. Bearing 33 engages the external surface of cylindrical section 32 and the internal surface of cylindrical section 24 to provide relative rotational movement between housing 22 and mounting bracket 23. A circular seal 34 encircles cylindrical section 32 and resides in appropriately sized grooves provided in housing 22 and mounting bracket 23 to prevent water from passing therebetween into the interior of boat 20. Bearing 33 and seal 34 are intended to be generally representative of various types of bearings and seals which are usable for the intended purpose and which will readily occur to those skilled in the art.

Figure 5:
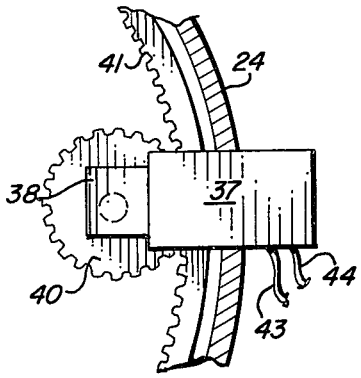
FIG. 5 is a horizontal sectional view taken along the line 5—5 of FIG. 2 and further detailing the steering apparatus thereof.

A reversible motor 37, as is also viewed in FIG. 5, having an angled speed reducing unit 38, is carried by mounting bracket 23. Shaft 39, extending from speed reducing unit 38 driven by reversible motor 37, carries pinion gear 40 which is drivingly engaged therewith. Internal ring gear 41 is carried by second cylindrical section 32 and meshes with pinion gear 40, whereby housing 22 is rotated in response to rotation of motor 37. As specifically illustrated, motor 37 is hydraulically actuated, receiving pressurized fluid from hydraulic pump 42 through lines 43 and 44 for forward and reverse rotation, respectively. The boat operator is provided with a hydraulical control device for selectively determining the direction and duration of rotation of motor 37. Although not specifically not herein illustrated, such hydraulic control devices are well known and are commerically available. The function and purpose of operative rotation of housing 22 will be explained presently.

Referring also to FIG. 3, it is seen that housing 22 has first and second ends 47 and 48, respectively, with a passage or water conducting channel 49 extending therebetween and terminating with first and second openings 50 and 51, respectively. Water conducting channel 49 is bounded by top and bottom plates 52 and 53, respectively, and side walls, 54 and 55. Since side walls 54 and 55 are irregularly shaped for reasons which will be herein explained later, housing 22 is streamlined by the addition of exterior side members 58 and 59. Exterior side members 58 and 59 reduce the drag which would otherwise be induced as water would move along the irregular surfaces of side walls 54 and 55.

A normally vertical shaft 60 extends upwardly from housing 22 at approximate the midpoint of water conducting channel 49 and is rotatably journalled in bearings 61 and 62 carried respectively in top plate 52 and bottom plate 53. Variable speed unidirectional motor 63 is mounted by means of frame 64 to housing 22 and drivingly rotates shaft 60. In the instant embodiment, motor 63 is hydraulically activated, receiving pressurized hydraulic fluid from pump 42. A commercially available speed control unit is interposed in the hydraulic line between the pump 42 and motor 63.

A propeller 67, having hub 68 with blades 69 extending radially therefrom, is rotatable with the shaft 60, being keyed, pinned or otherwise affixed thereto. Propeller 67 has a height which is closely received in the spacing between top and bottom plates 52 and 53. For purposes of reference, water conducting channel 49 can be considered to have a central chamber 70, intermediate chambers 71 and 72, and end chambers 73 and 74. In the area of central chamber 49, side walls 54 and 55 are arcuate to define a generally cylindrical chamber having side walls closely spaced to the tips of the blades 69. The purpose of propeller 67 is to urge water through water conducting channel 49. The close spacing of propeller 67 within central chamber 70 prevents the free movement or loss of water around propeller 67.

Figure 6:
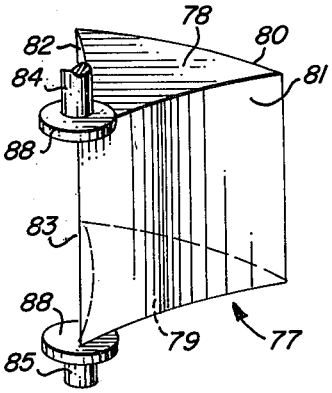
FIG. 6 is a perspective view, partly broken away, of a typical gate, as used in combination with the embodiment of FIG. 2.

Intermediate chambers 71 and 72 are similarly generally cylindrical as formed by arcuate sections of side walls 54 and 55. A gate 77, as also illustrated in FIG. 6, resides within each intermediate chamber 71 and 72. Gate 77 is generally wedgeshaped, having top and bottom surfaces 78 and 79, respectively, convex end 80 and concave sides 81 and 82. Sides 81 and 82 meet at an apex 83 which coincides with the axis of rotation of aligned shafts 84 and 85, which extend upwardly and downwardly, respectively from gate 77. The attachments of gates 84 and 85 to gate 77 are reinforced by circular flanges 88. It is noted that the lower surface of upper flange 88 lies in the plane of top surface 78, and the upper surface of lower flange 88 lies in the plane of lower surface 79.

Bearing 89, carried in the top blade 52 of housing 22, rotatably receives upper shaft 84, and, similarly, bearing 90 carried in lower plate 53, rotatably receives lower shaft 85. Intermediate sections 71 and 72 are generally cylindrical, being bounded on the sides by arcuate sections of side walls 54 and 55. Bearings 89 and 90 are set in top plate 52 and bottom plate 53 at the respective centers of cylindrical chambers 71 and 72, such that the axis of rotation of shafts 84 and 85 coincide with the longitudinal axis of the cylindrical chambers. Plates 52 and 53 are counterbored at bearings 89 and 90 to receive circular flanges 88, such that top surface 78 of gate 77 lies in close proximity to the undersurface of plate 52 and the bottom surface 79 lies in close proximity to the top surface of plate 53. The curvature of end 80 is congruent and lies in close proximity to the cylindrical walls of sections 71 and 72, as formed by side walls 54 and 55.

Both gates 77 are movable between a first position, as seen in solid outline in FIG. 3, in which back surface 80 is adjacent side wall 55, and a second position, illustrated by the dashed outline, in which end 80 is adjacent side wall 54. The curvature of side 81 is symmetrical with the curvature of side 82. In either the first or the second position, sides 81 and 82 form a continuation of the sides of cylindrical chamber 70 and lie in close proximity to the tips of blades 69.

Referring now to FIGS. 2 and 4, it is seen that shafts 84 extend upwardly above top plate 52. An arm 91 is secured to each shaft 84 and extends radially therefrom to form a crank for rotating gate 77 between the first and second positions. Double-acting hydraulic cylinder 92, having rams 93, extends between the arms 91. Each ram 93 is pivotally connected by means of pin 94 at the free end thereof to the free end of arm 91. As will be appreciated by those skilled in the art, double-acting cylinder 92 is connected through a hydraulic controller by means of fluid conduits 96 and 97 to hydraulic pump 42. The admission of pressurized hydraulic fluid through conduit 96 projects the ram outwardly, while the admission of pressurized hydraulic fluid through conduit 97 causes the rams 93 to contract. As shown in the solid outline, rams 93 are retracted and gates 77 are in the first position. When rams 93 are extended, arms 91 are moved to the dashed line position 91*a* and gates 77 move to the second position. During the extension of rams 93, hydraulic cylinder 92 moves to the dashed line position 92*a*. Hydraulic cylinder 92 may be mounted on a slide which will stabilize the cylinder longitudinally and permit lateral movement in accordance with well known practice in the art. Hydraulic pump 42 is illustrated as having two fluid conduits 98 and 99 extending therefrom. In accordance with conventional practice, pressurized hydraulic fluid is delivered from the pump through conduit 98 via the appropriate control devices to motor 37, motor 63 and cylinder 92, and returns generally through a reservoir through conduit 99.

The function of propulsion device 21 is best explained with primary reference to FIG. 3. As driven by motor 63 through shaft 60, propeller 67 rotates in the direction of arrow A. The direction of rotation of propeller 67 is unimportant with respect to the instant invention. The alternate direction is equally appropriate, and is largely determined by the direction of rotation of the motor chosen by the manufacturer or operator. If a motor is chosen which rotates propeller 67 in a direction counter to that indicated by the arrow A, the placement of components in the following description will result in the boat travelling in a reverse direction from that described.

As propeller 67 rotates, the swept volume describes a cylinder. For purposes of reference, the cylinder can be considered to be composed of two similarly cylindrical sectors, the first sector from a perpendicular plane passing through the axis of rotation of shaft 60 and the longitudinal axis of channel 47 to side wall 54. The second sector extends from the same plane to side wall 55. In the first sector, the propelling force of blades 69 is generally in the direction of arrow B. In the second sector, blades 69 generally tend to propel water in the direction of arrow C. With gates 77 in the solid line position, a first water path through channel 49 is defined as lying between the longitudinal axis of channel 49 and side wall 54. When gates 77 are moved to the dotted line position, the first path is blocked and a second path is revealed lying between the longitudinal axis of channel 49 and side wall 55. When gates 77 are in the first position opening the first path, water therein is urged in the direction of arrow B by blades 69. Water enters through first open end 50 and is discharged through second open end 51. Surface 82 of gate 77 and intermediate chamber 71 assists in directing water which is received through first end chamber 73 to the first path and to the first sector described by the cylinder of rotation of the propeller 67. The funnel opening of first end channel 73 assists in uniformly admitting ambient water, so that the admission of water to channel 49 will not disturb the steering characteristics of the boat. A plurality of vertical vanes 110 reside in first and second end chambers 73 and 74 respectively, and extend between top plate 52 and bottom plate 53. As water is discharged through second end chamber 74, vanes 110 tend to straighten the flow thereof, also for the purpose of stability of steering. From the foregoing description, it is readily seen that when gates 77 are moved to the second position, as indicated by the dashed outline, the second path through channel 49 will be opened, with water contacting propeller 67 in the second sector of the cylinder of rotation thereof, with water being moved in the direction of arrow C. In this case, water enters through second end chamber 74, is discharged through first end chamber 73, and the boat moves in the reverse direction as indicated by arrow E.

Boat 20 is steered or navigated by rotating housing 22. Since the boat moves in a direction opposite to the travel of water through channel 49, it is readily seen that it is only necessary to rotate the housing to cause angular changes in the direction of travel of the boat. The steering characteristics of the boat are determined by the placement of propulsion device 21. For example, if the propulsion device 21 is placed near one end of boat 20, that end will have a tendency to swing wide during turns. On the other hand, if propulsion device 21 is placed near the center of gravity of boat 20, the boat, during turning, will tend to pivot about the center of gravity.

It is immediately apparent, therefore, that no auxiliary steering apparatus, such as a conventional rudder, need be utilized in conjunction with the propulsion device of the instant invention. It is also apparent that the housing 22 need only rotate 90° in either direction to accomplish a full range of steering. The advantages of the instant invention are immediately apparent when considered in combination with a conventional sport fishing boat. Fishermen generally desire to manuever their boats along the shoreline of a lake, or into channels or arms extending from the main body of the water, in order to gain access to the fish's habitat among submerged hazards, snags and marine growth. With conventional drive and steering apparatus, the fisherman is prohibited from entrance to certain areas. In other areas, the drive and steering mechanism frequently becomes entangled and occasionally damaged.

the marine propulsion device of the instant invention would increase the draught of a conventional sporting fishing boat less than three inches, therefore water depth does not become a barrier. Since the moving components of the device are encased in a housing, the possibility of damage or entanglement is exceedingly remote. Should floating debris or marine growth be drawn to the water entrance, it would be prohibited from entering the water channel by the vanes. Such debris can be blown free by moving the gates to the alternate position and reversing the water flow momentarily. Further protection against debris can be had by placing a screen over the ends of the housing. Additionally, the ends of the housing may be beveled downwardly rearwardly to assist the unit in passing over snags and hazards. Another advantage is seen in the increased maneuverability of the craft. Also, as a convenience to the fisherman, the craft may be made to stand still without stopping the motor by simply placing the gates in an intermediate position to retard water flow through the channel.

Figure 7:
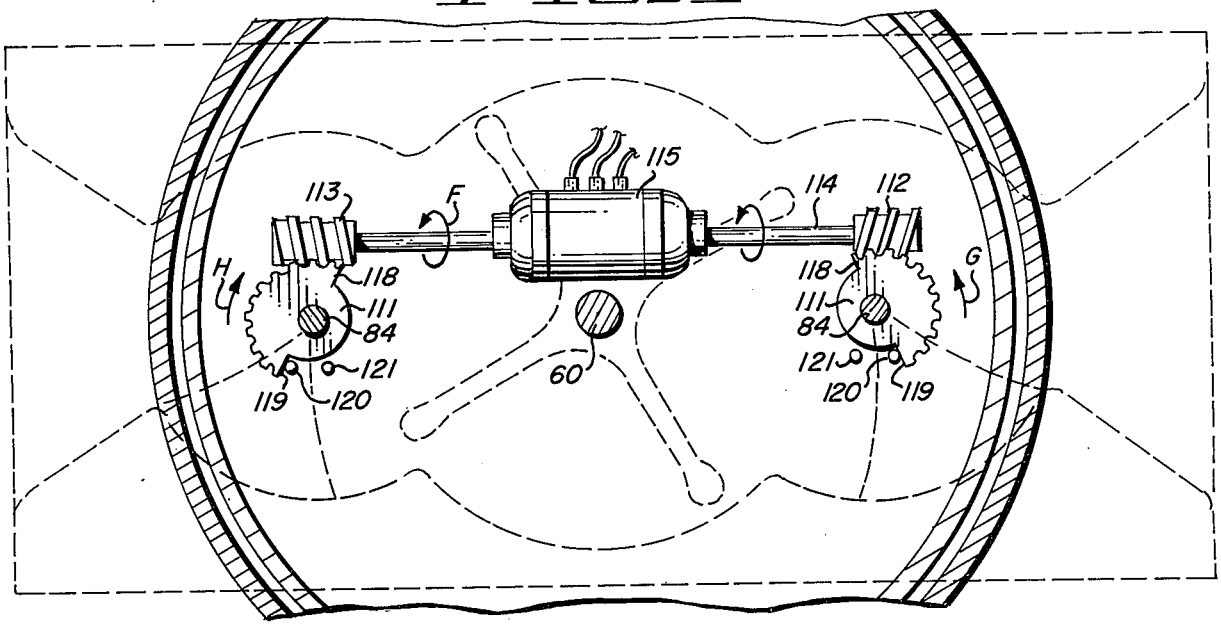
FIG. 7 is a horizontal sectional view generally corresponding to the view of FIG. 4, and illustrating an alternately preferred mechanism for moving the gates.

FIG. 7 illustrates an alternate embodiment of the instant invention in which a sector gear 111 is secured to shaft 84 in lieu of arms 91. Each sector gear 111 is in driving engagement with one of a pair of worm gears 112 and 113, which are carried by drive shaft 114 of reversible motor 115. As illustrated, worm gear 113 has a right-hand helix, while worm gear 112 has a left-hand helix. When motor 115 is energized to rotate shaft 114 in the direction of arrow F, sector gears 111 rotate in opposite directions as denoted by the respective arrows G and H. Counter-rotation of motor 115 rotates the respective sector gears 111 in opposite directions. Gates 77 are, therefore, in response to the rotation of motor 115, moved between first and second positions, as previously described in detail.

At high speeds, substantial forces may be generated against one side of each gate 77. To insure that the gates are not displaced and hold against the force, various stop arrangements may be provided. In accordance with the instant embodiment, sector gear 111 is provided with shoulders 118 and 119. Pins 120 and 121 are carried by the housing. When gate 77 is in the first position, shoulder 119 abuts pin 120, and when gate 77 is in the second position, shoulder 118 abuts pin 121. A similar stop arrangement may be incorporated into the embodiment of FIG. 4.

Figure 8:
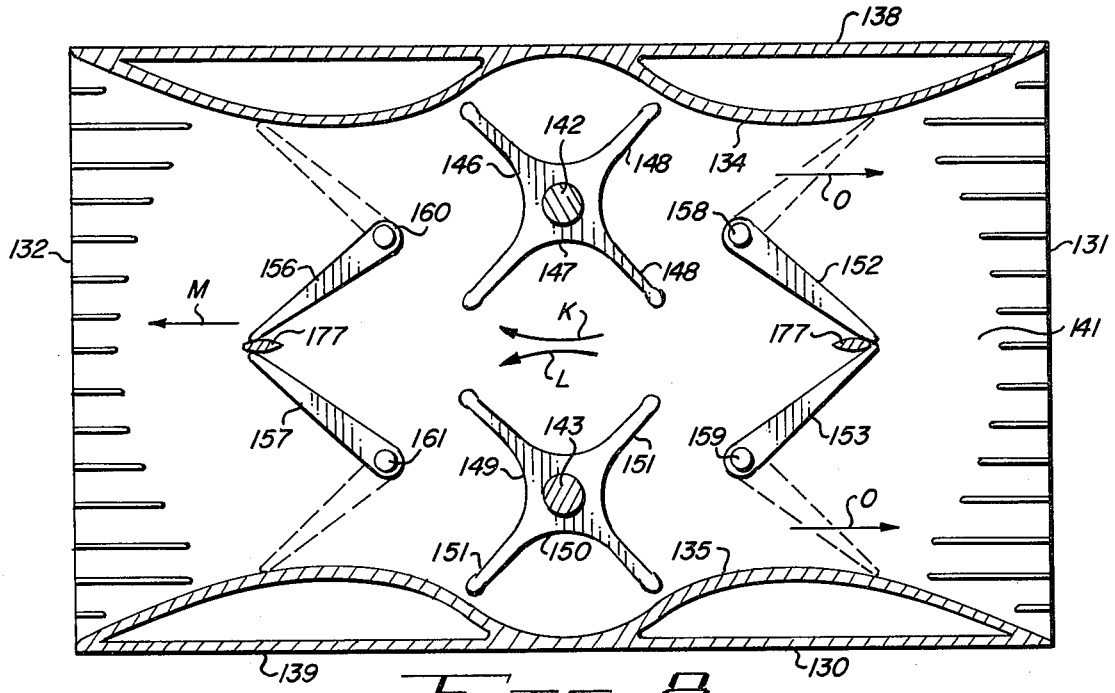
FIG. 8 is a horizontal sectional view generally corresponding to the view of FIG. 3, except showing an alternately preferred embodiment of the instant invention.
Figure 9:
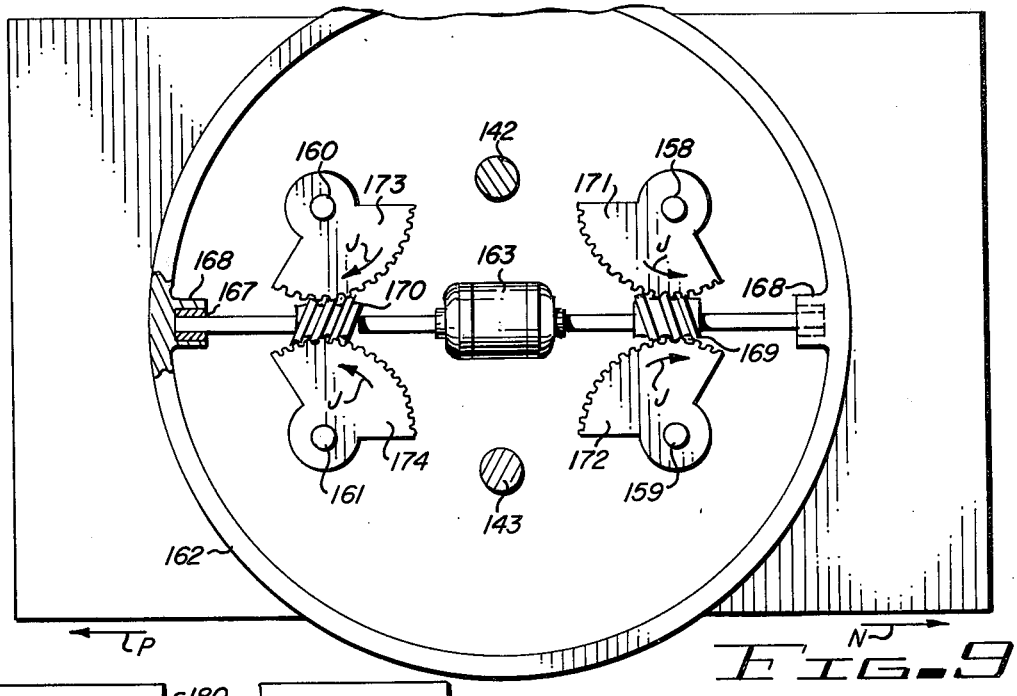
FIG. 9 is a horizontal sectional view generally corresponding to the view of FIG. 7, except illustrating means for controlling the gates of the embodiment of FIG. 8.

FIG. 8 illustrates an alternately preferred embodiment of a marine propulsion device constructed in accordance with the teachings of the present invention, and including a housing 130 having first and second ends 131 and 132. Similar to the previously described housing 22, housing 130 has a water channel 133 therethrough lying between side walls 134 and 135. Exterior side members 138 and 139 streamline the exterior of the housing. With further reference to FIG. 9, it is seen that water channel 133 is enclosed also by top and bottom plates 140 and 141.

Drive shafts 142 and 143 are rotatably journalled in top plate 140 and bottom plate 141. Each shaft 142 and 143 is rotated by a motor herein not specifically shown. As will be apparent to those skilled in the art, each shaft may be directly rotated by a single power source, as previously described in connection with shaft 60, or, alternately, united with a single power source, as through a gear or chain drive. The rotation of each shaft 142 and 143 is unidirectional and counter to the rotation of the other shaft.

A first propeller 146, including hub 147 having radial vanes 148 extending therefrom, is rotatably engaged with drive shaft 142. Similarly, a second propeller 149 having hub 150 and radial blades 151 is drivingly engaged with shaft 143. Each propeller 146 and 149 is rotatable about a normally vertical axis. The axes of rotation are at the proximate midpoint of housing 130 and are spaced laterally relative the water channel by a distance, such that the cylinders of rotation of the propellers are preferably tangential.

For purposes of reference, each cylinder of rotation of each propeller can be considered as comprising two semi-cylindrical sectors. The division for each sector is a plane extending through the axis of rotation of each respective shaft and being parallel to the longitudinal axis of the water channel. The sectors which lie near the center of the channel are the adjacent sectors, while the sectors near the side walls are termed the opposite sectors.

Located within channel 133, between propellers 146 and 149 and first end 131, is a first pair of gates 152 and 153. Similarly, within channel 133, between propellers 146 and 149 and second end 132, there resides a second pair of gates 156 and 157. Gates 152, 153, 156 and 157 are carried by shafts 158, 159, 160 and 161, respectively, which are rotatably journalled in top plate 140 and bottom plate 141. Each gate is movable between the illustrated solid outline position and the respective dashed outline position.

As more particularly seen in FIG. 9, a cylindrical section 162 extends upwardly from top plate 140. Cylindrical section 162 cooperates with a mounting bracket in a manner analogous to cooperation between cylindrical section 24 and mounting bracket 23. A reversible motor 163 is carried by a frame member secured to cylindrical section 162. For clarity of illustration, the frame member is not herein specifically illustrated, but may consist simply of arms extending between motor 163 and cylindrical section 162. Drive shaft 164 extends from either end of reversible motor 163 and is rotatably journalled at the free ends thereof in suitable bearings 167 carried in bosses 168 extending radially inward from cylindrical section 162. Drivingly carried by the drive shaft 164 are right and left hand worm gears 169 and 170, respectively.

Sector gears 171, 172, 173 and 174 are respectively drivingly engaged with shafts 158, 159, 160 and 161. Sector gears 171 and 172 are in driving mesh with worm gear 169. Worm gear 170 drives sector gears 173 and 174. In response to right hand rotation of motor 163, each sector gear rotates in the direction of the respective arrow J. As the result thereof, the gates are moved to the respective dashed line positions. Left hand rotation of motor 163 will return the gates to the solid line positions.

The actual direction of rotation propellers 146 and 149 is unimportant. For purposes of explanation, it is assumed that propeller 146 turns in the direction of arrow K, while propeller 149 turns in the direction of arrow L. When the gates are in dashed line positions, a first path through channel 133 is opened generally central of the channel. Water is directed to the adjacent sectors of the cylinders described by the revolution of the propellers. Water is moved in the direction of arrow M and the vessel moves in the direction of arrow N.

When the gates are moved to the solid line positions, a second path is defined. The second path is a split path along either outboard side of channel 133, wherein water is directed against the opposite sectors and moved in the direction of arrow O, propelling the craft in the direction indicated by the arrow P, or reverse to the direction of arrow N.

Stop members 177 brace the gates against the force of the water in one direction. In the other direction, the gates bear against the respective side walls. Further reinforcement can be had by providing each of the sector gears with a shoulder and pin arrangement, as described in connection with FIG. 7.

Figure 10:
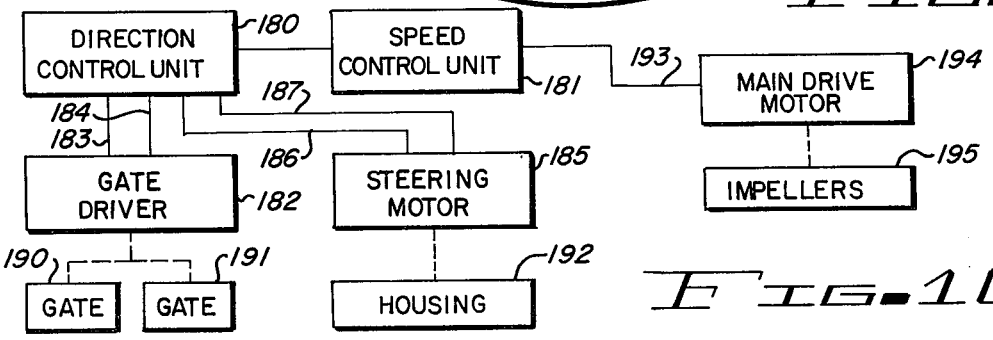
FIG. 10 is a schematic representation, in block diagram form, of a marine navigating system based on the propulsion device of the instant invention .

FIG. 10 schematically illustrates a marine navigating system based upon the propulsion device of the instant invention. Placed in the operator's compartment is a direction control unit 180 and a speed control 181. Preferably direction control unit 180 is of the "joy stick" type, having a single control lever which is movable in forward, reverse, left and right directions to provide the operator with four selective functions. The directions control 180 communicates with gate driver 182 through lines 183 and 184, and with steering motor 185 through lines 186 and 187. Gate drive 182 as used herein is generic to hydraulic cylinder 92, motors 115 and 163 and other equivalent species. Steering motor 115 includes hydraulic motor 37 and other equivalent devices which may be powered by means other than hydraulic, such as electric.

When the lever of direction control unit is moved forward, communication is established through line 183 to gate driver 182, which moves gates 190 and 191 to the position required for forward travel. Moving the lever of direction control unit 180 to the rearward position establishes communication through line 184 to gate driver 182, resulting in a change in the position of gates 190 and 191 to power the vessel in a reverse direction. Similarly, movement of the lever to the left or right establishes communication through lines 186 and 187 for forward and reverse rotation, respectively, of steering motor 185 and rotation of housing 192 in the appropriate direction. Through the proper selection of components, as are well known in the art, the distance to which the control lever is moved to the right or left will control the turning radius of the craft.

Speed control unit 181 is a throttle, which, through line 193, regulates the speed of drive motor 194. Hence the speed of rotation of impeller 195 and the speed of the craft.

Various changes and modifications to the embodiments herein chosen for purposes of illustration will readily occur to those skilled in the art. For example, the embodiment of FIG. 2 has been described as being hydraulically operated, while another embodiment utilizes a electric motor for positioning the gates. It is within the scope of the instant invention that various power sources be utilized in accordance with the desires of the particular manufacturer. A gasoline motor is immediately apparent for driving the impeller. In this regard, it is noted that the impeller may be provided with a dual power source, such as electric and gasoline, either motor being selected by the operator through a clutch and transmission apparatus. This would provide the fisherman with high speed and cruising ability, or extreme slow speed for maximum maneuverability or trolling.

With prior art marine drive units, it is necessary to rotate the propeller in a reverse direction in order to reverse the direction of the craft. For obvious reasons, the propeller must be slowed to a stop and then put into reverse. Since the device of the instant invention utilizes a propeller which rotates constantly in one direction and forward and reverse propulsion of the craft is controlled by the gates, the device may be put into reverse, regardless of the forward velocity of the craft. This function provides an effective breaking action for quickly slowing or stopping the craft. It is also suggestive that the propeller can be rotated at a constant velocity, with velocity and direction changes of the craft made a function of the gates.

Having fully described and disclosed the present invention, and the presently preferred embodiments thereof, in such clear and concise terms as to enable those skilled in the art to understand and practice the same, the invention claimed is:

1. A propulsion device for use in combination with a marine vessel, said propulsion device comprising:

a. a housing for attachment to said vessel below the waterline thereof and including a water conducting channel extending through said housing and having first and second open ends, said channel having first and second water paths defined therein and extending longitudinally through said channel;

b. a propeller for urging water through said channel and journalled within said housing for unidirectional rotation about a normally vertical axis, said propeller having a first sector described by the cylinder of rotation thereof lying in said first water path and second sector described by the cylinder of rotation thereof lying in said second water path;

c. a first gate pivotally carried by said housing within said channel intermediate said propeller and said first open end and movable between a first position and a second position for selectively obstructing respective said water paths and for exposing water to said second and said first sectors, respectively, of said propeller;

d. a second gate pivotally carried by said housing within said channel intermediate said propeller and said second open end and movable between a first position and a second position for selectively obstructing respective said water paths and for exposing water to said second and said first sectors, respectively, of said propeller;

e. means for operative synchronous movement of said first and said second gates between respective said first and said second positions, whereby said vessel is propelled in one direction when water is selectively exposed to said first sector and is propelled in a reverse direction when water is selectively exposed to said second sector.

2. The propulsion device of claim 1 wherein:

a. said first gate is pivotal about a generally vertical axis intermediate said first open end and said propeller and intermediate said first and said second water paths; and b. said second gate is pivotal about a generally vertical axis intermediate said second open end and said propeller and intermediate said first and said second water paths.

3. The propulsion device of claim 1 further including:

a. a mounting bracket carried by said vessel and rotatably carrying said housing; and b. reversible drive means for selectively rotating said housing relative said mounting bracket;

whereby said vessel is navigated in response to rotation of said housing.

4. The propulsion device of claim 1, further including a second propeller for urging water through said channel and journalled within said housing for unidirectional rotation about a normally vertical axis laterally displaced from the axis of first said propeller relative said channel, the unidirectional rotation of said second propeller being in a direction opposite to the direction of rotation of first said propeller, said second propeller having a first sector described by the cylinder of rotation thereof lying in said first water path and a second sector described by the cylinder of rotation thereof lying in said second water path.

5. The propulsion device of claim 4 wherein:

a. said first water path is defined as lying between the axes of said propeller; and b. said second water path is defined as having a subpath lying on either side of said first water path.

6. The propulsion device of claim 4 further including:

a. a third gate pivotally carried by said housing within said channel and laterally disposed and synchronously operative with said first gate for selectively obstructing said water paths; and b. a fourth gate pivotally carried by said housing within said channel and laterally disposed and synchronously operative with said second gate for selectively obstructing said water paths.

7. The propulsion device of claim 4 further including:

a. a mounting bracket carried by said vessel and rotatably carrying said housing; and b. reversible drive means for selectively rotating said housing relative said mounting bracket;

whereby said vessel is navigated in response to rotation of said housing.

* * * * *